US006273645B1

(12) United States Patent
Hamre

(10) Patent No.: US 6,273,645 B1
(45) Date of Patent: Aug. 14, 2001

(54) POSITION PENETRATED ANCHOR SYSTEM

(76) Inventor: Olav Hamre, Todnembakken14, N-4070 Randaberg (NO)

( * ) Notice: Subject to any disclaimer, the term of this patent is extended or adjusted under 35 U.S.C. 154(b) by 0 days.

(21) Appl. No.: 09/402,264

(22) PCT Filed: Apr. 1, 1998

(86) PCT No.: PCT/NO98/00102

§ 371 Date: Oct. 1, 1999

§ 102(e) Date: Oct. 1, 1999

(87) PCT Pub. No.: WO98/46833

PCT Pub. Date: Oct. 22, 1998

(30) Foreign Application Priority Data

Apr. 2, 1997 (NO) ..... 971478

(51) Int. Cl.[7] ..... E02D 5/80

(52) U.S. Cl. ..... 405/224.1; 405/195.1; 405/224; 405/226; 175/6; 114/265

(58) Field of Search ..... 405/195.1, 223.1, 405/224, 224.1, 226; 175/6; 37/345; 114/164, 165

(56) References Cited

U.S. PATENT DOCUMENTS

| | | | | |
|---|---|---|---|---|
| 2,637,978 | * | 5/1953 | Evans et al. | 405/224 |
| 3,846,991 | * | 11/1974 | Wisotsky | 405/228 |
| 4,114,393 | * | 9/1978 | Engle, Jr. et al. | 114/264 |
| 4,260,291 | * | 4/1981 | Young et al. | 405/205 |
| 4,817,734 | | 4/1989 | Kuehn . | |
| 4,881,850 | * | 11/1989 | Abreo, Jr. | 405/169 |
| 4,886,395 | * | 12/1989 | Moles et al. | 405/169 |
| 5,445,476 | * | 8/1995 | Sgouros et al. | 405/224 |
| 5,533,574 | * | 7/1996 | Gonzalez | 166/358 |
| 5,992,060 | | 11/1999 | Treu et al. . | |
| 5,997,218 | * | 12/1999 | Borseth | 405/223.1 |
| 6,007,275 | * | 12/1999 | Borseth | 405/224 |
| 6,106,198 | * | 8/2000 | Borseth | 405/223.1 |

FOREIGN PATENT DOCUMENTS

| | | |
|---|---|---|
| 23 34 418 | 1/1975 | (DE) . |
| 2 444 755 | 7/1980 | (FR) . |
| 2 069 902 | 9/1981 | (GB) . |
| 2 148 968 | 6/1985 | (GB) . |
| 803 927 | 8/1981 | (NO) . |
| 303 025 | 5/1998 | (NO) . |
| 305 872 | 8/1999 | (NO) . |
| 350 556 | 10/1972 | (SE) . |
| WO 95/20075 | 7/1995 | (WO) . |

* cited by examiner

*Primary Examiner*—Thomas B. Will
*Assistant Examiner*—Gary S. Hartmann
(74) *Attorney, Agent, or Firm*—Young & Thompson

(57) ABSTRACT

The invention relates to a method for installing anchors on the bottom of the sea. Wires (4) and a suction anchor (2) are attached to a frame (1). Through the centre of the frame's vertical axle a mounting device (6) for an anchor holder (7) is placed. The frame (1) works as a driving ramp for different shaped anchor holders and anchors (5, 15, 20). With the mounting device (6) the anchor penetrates the bottom of the sea at a certain position. A remote operated vehicle (ROV) and/or a hydraulic motor and pump gives a hydraulic torque for boring screwing, pressing and stamping effects. A helical screw-anochor is used for rotary screwing into the bottom of the sea (3). The span and the gradient are varied given to geological data for achieving holding forces. After use the anchor is released with a releasing mechanism (13, 14) and is left on the bottom of the sea.

20 Claims, 9 Drawing Sheets

POSITION PENETRATED ANCHOR SYSTEM

BACKGROUND OF THE INVENTION

1. Field of the Invention

The invention concerns a method for establishing and connecting and disconnecting positioned anchorage points in different sea floor formations, together with equipment for the same, arising from the need which exists when anchoring floating units, independently of water depth.

When an object floating on the surface of the sea requires to be kept in position for various reasons, an anchor is employed. This consists of a heavy body, which is lowered on to the sea floor connected to a cable from the floating object. By means of its shape the anchor offers the possibility of becoming fixed to or exerting friction on the sea floor. For example, a ship which loses engine power at sea will make use of a traditional and simple anchor of this kind. In the same way this method of anchoring is employed by ships which are lying in the roadstead, waiting to put in at a quay, etc. The positioning requirements for ships in such circumstances are minimal, and the ship will normally be able to rotate freely 360° round the mooring point, according to the state of the current and wind direction.

Floating objects, such as drilling platforms, production ships and the like, associated, e.g., with the oil and gas industry, have completely different and more stringent requirements for their positioning with consequent requirements for anchoring. This is due to the submerged pipe installations which extend approximately linearly from the drilling floor vertically through the water and on down deep to the oil and gas-bearing formations in the earth's crust.

Present day technology masters positioning of this kind down to a depth of approximately 700 meters, by the use of cable anchoring down and out from the platform, the number normally varying from eight to sixteen catenaries with attached plate anchors, or fluke anchors, at a cost of from NOK ½ mill. to 2 mill. These catenaries, e.g., are generally approximately four to six times as long as the distance to the bottom, and are deployed radially with the platform as the central point. In the outer end part of each chain there is attached a fluke anchor, which is designed to dig into the sea bed for securing co-operation with the sea floor when it is pulled over it towards the platform by anchor-taying vessels and/or the floating unit's own established tractive power.

Varying conditions on the sea floor and poor inspection capability reduce the certainty of secure and permanent anchoring in times of severe stress, with the result that unnecessarily stringent requirements are usually placed on the number of anchor points. Due to their high price, amongst other things, attempts must always be made to raise these fluke anchors for reuse.

Slack catenary mooring permits the platform, when exposed to wind and current forces, to drift in the horizontal plane in any direction from the central position to an extent corresponding to up to 5° from the vertical plane.

Another method of attachment to the sea floor is a suction anchor. This is a metallic, bell-shaped anchor body with the opening facing down towards the sea floor. By means of a vehicle remotely operated from the surface of the sea, a ROV (Remotely Operated Vehicle), the water is pumped out of the body's internal volume, in order that the hydrostatic differential pressure at such depths should cause the body to be pulled/pressed down into and secured to the bottom. By this means a greater degree of controllable and inspectable attachment is achieved, thus permitting a substantially tauter mooring, with a shorter catenary.

Another remotely operated method of attachment at great depths is by ramming down hollow tubes by means of hydraulic hammer power, which tubes are thereby anchored in the bottom.

Securing by drilling in the bottom permits cylindrical hollow pipe anchors to be lowered, where cement is filled in cavities around and inside the cylinder. A catenary can then be attached to both the anchors' upper and top part projecting up from the bottom, or it is made fast to the anchors' central part projecting down into the bottom layer, in order thereby to exploit the resistance forces which arise when a body is pulled towards and through a surrounding mass.

Tension leg mooring is also employed, where anchors in the bottom with vertical catenaries attached to the stays counteract the platform's buoyancy by pulling it down in the water to an extent which has a stabilising effect.

Slack lines will occupy large areas in the sea and on the sea floor around a platform. It is undesirable for such lines to cross a flow line and/or another installation. Cables of metallic chain loops are heavy, also because each of these cables normally represents four to six times the sea depth. For example, a platform at 300 meters deep employing 10 catenaries of 1800 meters each will altogether have deployed 18000 running meters of chain. When the chain weighs 160 kg/running metre, the total weight is 2,900 tons. If a theoretical anchoring with the same means were performed at 3000 meters depth, the catenary weight would amount to 29,000 tons.

At such depths other catenaries have to be employed. Steel cable, e.g., weighs approximately a third of the weight of chain, and yet 3000 m of the dimension concerned weighs approximately 50 tons, forming an enormous coil. Composite cable systems will also be bulky, but such cables submerged in water are almost weightless.

A typical catenary can therefore be assembled by using large size steel cable or chain in the lower end part with a plate anchor to weight it down; from the floating unit steel cable or chain. The length between lower steel cable/chain and upper steel cable/chain is composed of composite fibre rope, the splicing being performed by means of special connecting units.

The method of the invention for establishing and connecting and disconnecting positioned anchorage points in different sea floor formations is primarily developed for operations at great depths with high hydrostatic pressure, which makes it difficult if not impossible, also from the cost point of view, to employ the present day known technology developed for moderate depths, for transferring, amongst other things, prevailing forces, catenary weights and dimensions, requirements for positioning, inspection, etc.

Known technical equipment which is employed in such subsea operations is a power-generating ROV (Remotely Operated Vehicle), which, at great depths with the necessary capacity with a hydraulic pump, produces the torque, tractive power and high liquid pressure for jetting and injecting effects.

A ROV is arranged to secured itself to the installation frame.

This is necessary to enable the ROV during turning work operations, such as screwing down wide-threaded cylindrical hollow threaded anchors or drilling in the seabed, to counteract the torque or recoil forces from high-pressure jetting and injecting to which it is exposed. The establishment of such power-generation on the installation frame is due to the fact that working at great depths complicates the operation supplying power from the surface.

From the patent literature the following publications are known:

NO 803927 describes a submersible percussion hammer which is surface-operated from a platform, which is supported by a truncated pyramidal frame which projects upwards from sea floor level.

NO 952476 describes a method for penetrating hollow cylindrical anchors in the sea floor, where the anchors with connecting means are coupled to a pillar of anchors stacked on top of one another, where the pillar's specific weight helps to ram one anchor after another down into the bottom, where these anchors are interconnected by lengths of chain which determine the distance between the anchors' chain-forming positions.

FR 2.444.755 describes a hollow helically flanked injector for anchoring and reinforcement of loose masses, in that after being screwed down into loose soil it permits a material which sets, e.g. liquid concrete, to be injected. The device is obviously surface-operated, and in itself does not represent an anchoring function.

SE 350.556 describes a percussion jetting device which is attached around the lower end part of a pile, which during surface-operated ramming into the ground with high-pressure water through obliquely downwardly jetting nozzles, achieves an easier/faster penetration in loose earth masses and the like.

PCT/WO 95/20075 describes a bell-shaped suction anchor coupled to and connected with one or more containers, where an underpressure has been created by pumping out water at a great depth. By repeated sudden opening and closing to the container's underpressure through the connection to the suction anchor's interior cavity, the shock-like pressure changes are transferred to the suction anchor, which penetrates the sea floor due to the hydrostatic differential pressure. The device which contributes to lowering the suction anchor here is the attached underpressure container(s). A standard suction anchor consists only of the bell-shaped body, which with its opening facing down on to the sea floor is first pumped empty of water, whereupon a high hydrostatic differential pressure builds up at great depths. By suddenly opening to this pressure, the suction anchor will be brought down into the bottom masses.

GB 2.148.968 describes a hollow cylindrical retrievable anchor, with outwardly and downwardly foldable curved arms suspended attached at 90° to the anchor body. The anchor's function is to create concrete foundations under sea floor level, and then to be pulled up. The arms are folded into the lower part of a cylindrical anchor body, also by the pressure from the environment when being rammed down into the sea floor, but are folded out by the anchor being pulled slightly up and back, the arms' outer parts being turned inwards, thereby taking hold of the surrounding masses and on account of the resistance therefrom being forced into an oscillating movement from an enclosed position to a 90° extended position on the anchor body. The ramming down operation is repeated by extending the anchor body by joining on new hollow units, and the longitudinal cavity is jetted with water. When the lower position has been reached, liquid concrete is added through the cavity. Retrieval for repeated use of the anchor is performed by lowering it further into the sea floor while jetting with water, with the result that the surrounding masses press the arms in towards the anchor body. The device may be described as an anchoring medium, and is presumed to be surface-operated, for reinforcement of the ground's supporting capacity, also because the force employed for the ramming down operation is not described.

SUMMARY OF THE INVENTION

The method according to the invention is based on establishing anchorage points which by means of recordable resistance force, permit a substantially more vertical path in the water for the catenaries concerned, in order thereby to reduce the length and weight of the catenaries, and to reduce the sea floor area which is occupied during an installation of a ready-installed system.

This is also achieved by the fact that surrounding curved plate anchors hinged in the anchor holder's upper or lower part will oscillate up and out or down and out to a 90° locked position on the anchor body when it is exposed to an upwardly or downwardly directed force.

At the same time the method requires and permits a high degree of accuracy in positioning of the anchorage points.

DETAILED DESCRIPTION OF THE INVENTION

To act as a ramming down ramp by securing and supporting the anchor holders and controlling penetration thereof, a truncated pyramidal frame, e.g., may be used consisting of one or more connected, e.g. inwardly sloping or vertically located legs, which are connected to one or more suction anchors, in order to become fixed to the bottom before an operation for ramming down an anchor. To each of the upper ends of the frame legs there are attached wirelines, which are used for lowering the frame from the surface to the sea floor.

Centrally through the frame's vertical axis there is attached control and suspension equipment for the insertion of the anchor holders concerned possibly with a carrier for the respective operation.

Anchor holders for different anchors are mounted in a vertical position through the framers suspension equipment before lowering to the sea floor or are inserted in the frame after it has been established on the sea floor.

The cylindrical or square anchor holders concerned are hollow or solid and arranged for penetrating the sea floor, and by means of their design and extension in the longitudinal direction adapted to different bottom conditions.

An anchor holder which is jetted, injected, pressed/pushed or lowered into established holes has simplified, flat plate attachments secured around both cylindrical and square hollow anchor holders.

The common feature of the anchor holders with anchors concerned is that when the floating unit is moved they have to be left in their bed on the sea floor with a release mechanism which breaks the securing co-operation in the shackle between the anchor and catenary. This takes place under sea floor level if the anchor is left for good, and at sea floor level with a retrieval marker if the anchor is to be used again.

Figure 1:
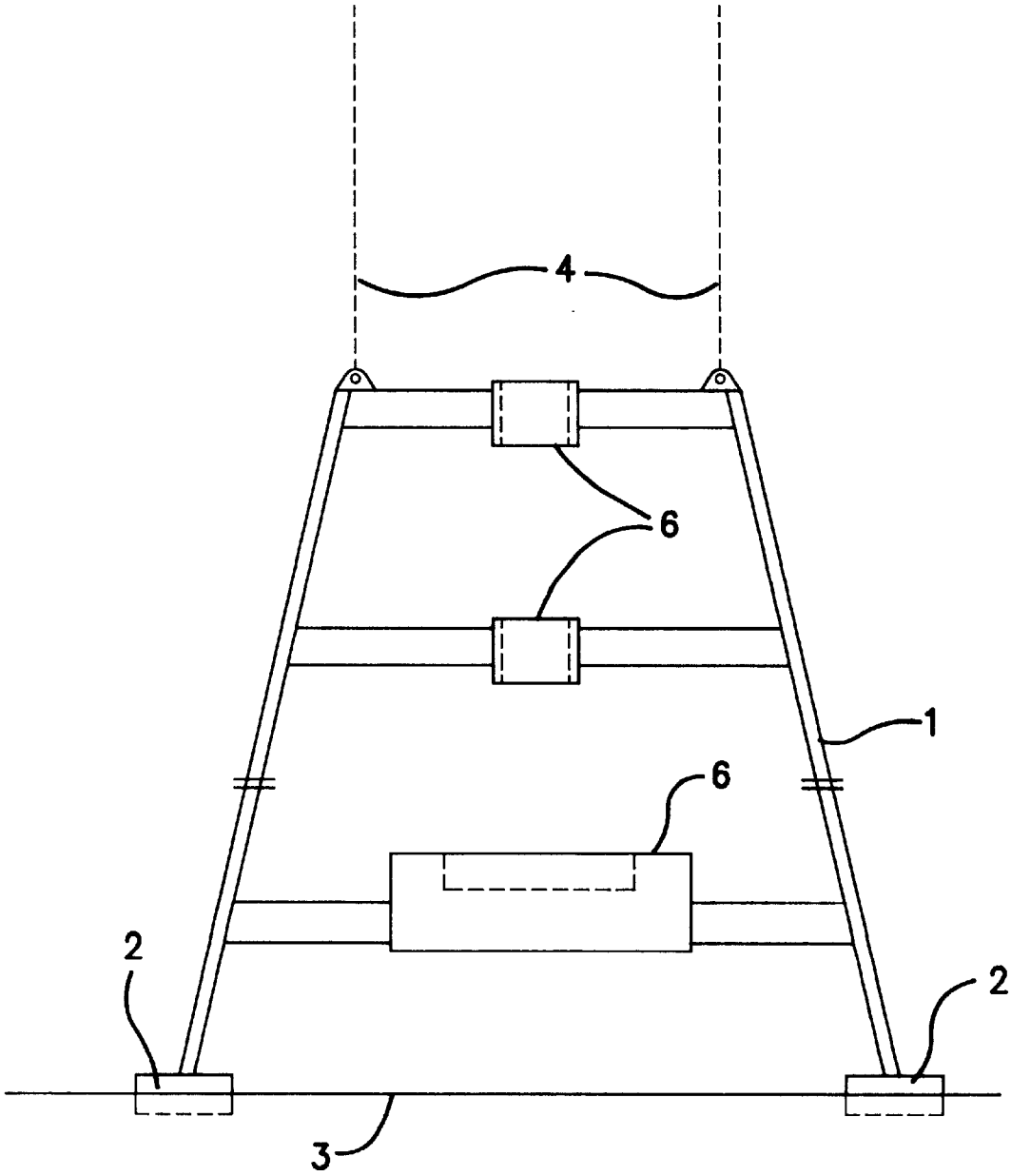
FIG. 1 illustrates an embodiment of the ramming down ramp of the invention.

FIG. 1 illustrates a truncated pyramidal frame 1 consisting of four connected inwardly sloping legs, which act as a ramming down ramp by securing and supporting the anchor holders and controlling penetration thereof. A frame with one or more vertically located legs is also a relevant design. The frame is connected to one or more suction anchors 2 in order to become fixed to the sea floor 3 before a ramming down operation. To the frame there are attached wirelines 4 which are used for lowering the frame 1 from the surface to the sea floor.

Figure 2:
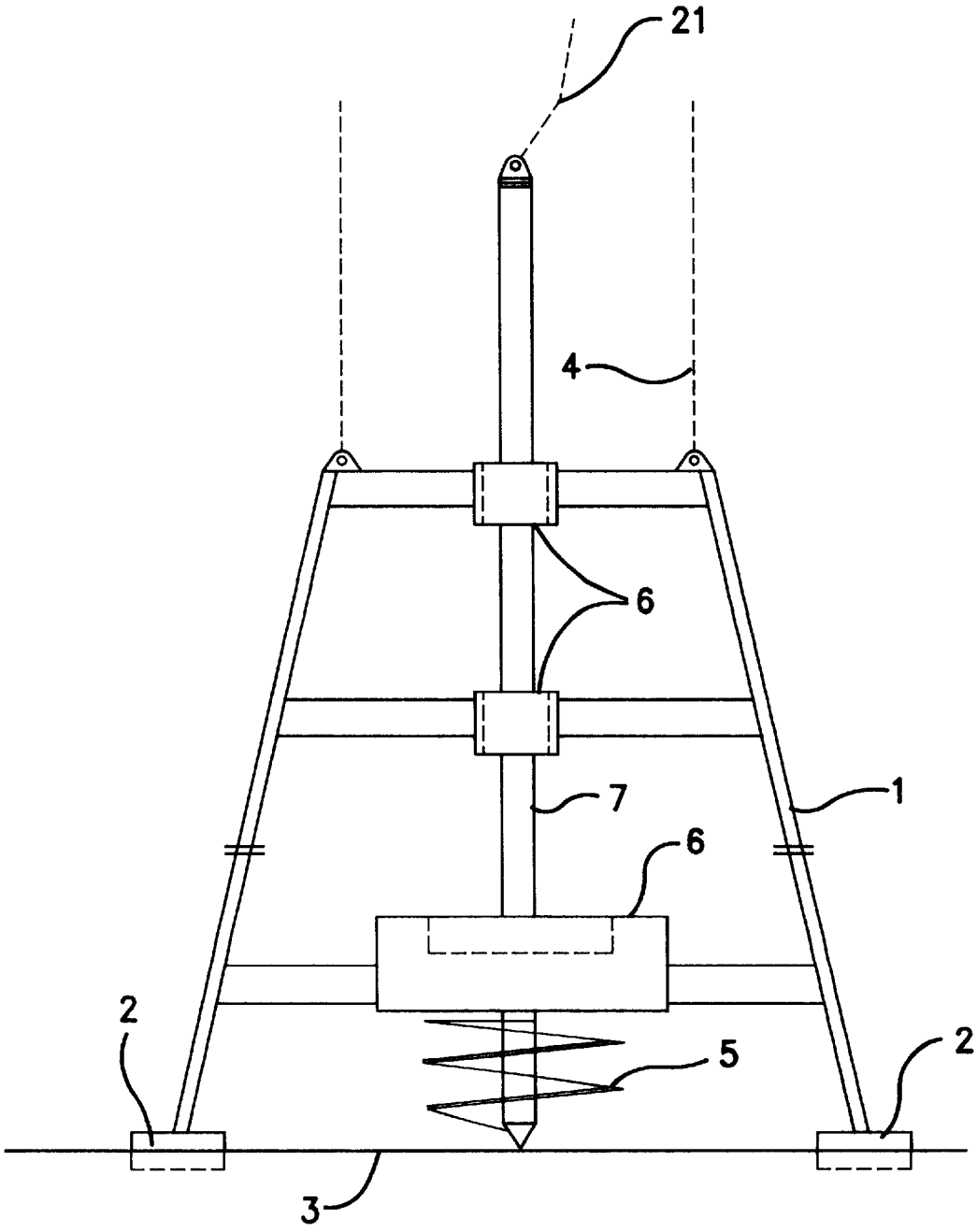
FIG. 2 illustrates an embodiment of the invention in which the anchor is a threaded anchor.

FIG. 2 illustrates schematically a helically flanked threaded anchor 5 with an anchor cable 21 attached to the anchor holder 7 vertically disposed through the frame's 1 suspension equipment 6. The illustrated flank width and pitch exemplify the design of these anchors and are determined by the sea floor mass's geotechnical data in order to obtain recordable and predictable characteristics for resistance forces.

Figure 3:
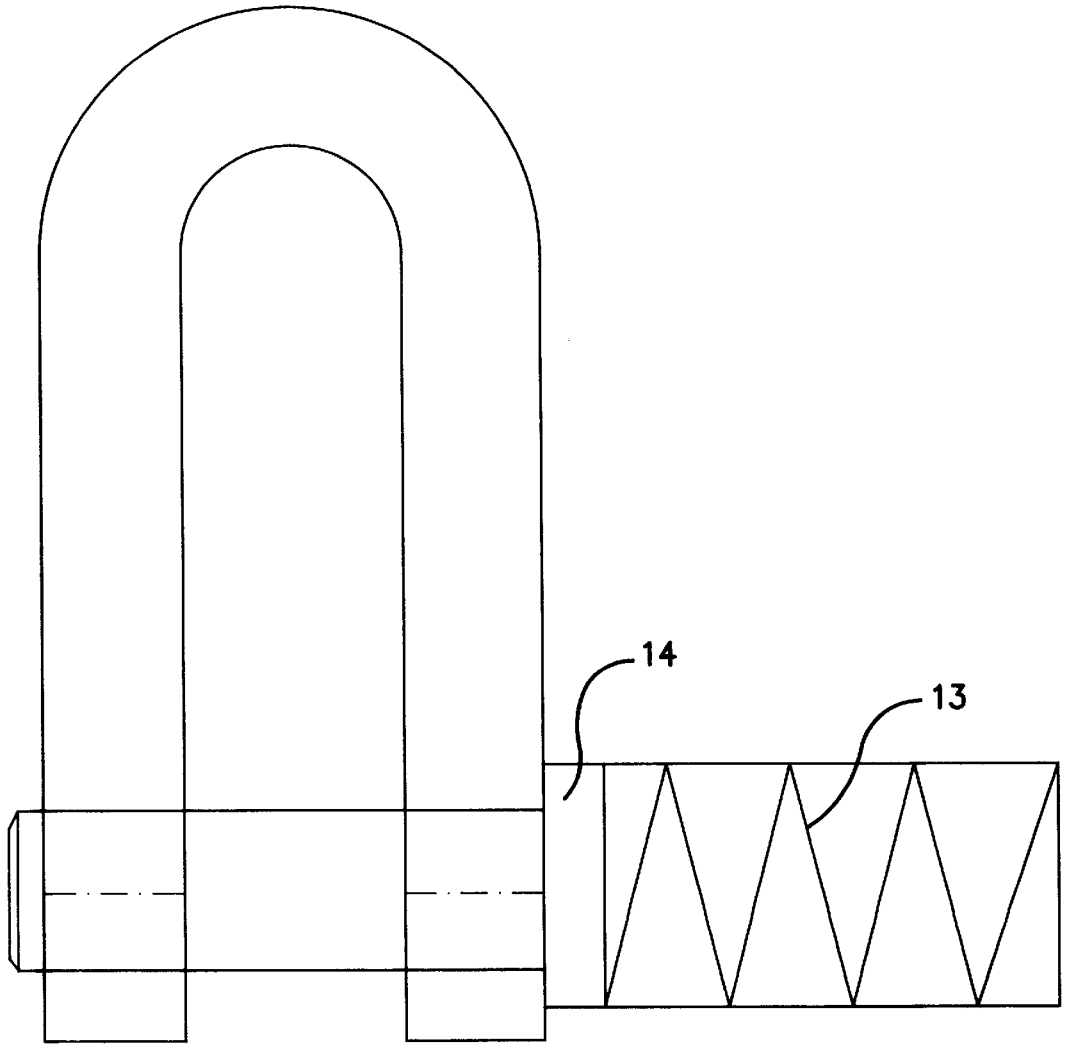
FIG. 3 illustrates a release mechanism for use with the present invention.

FIG. 3 illustrates schematically a release mechanism arranged through a securing shackle for the catenary's attachment to the anchor with a tension spring 13 and piston 14.

Figure 4:
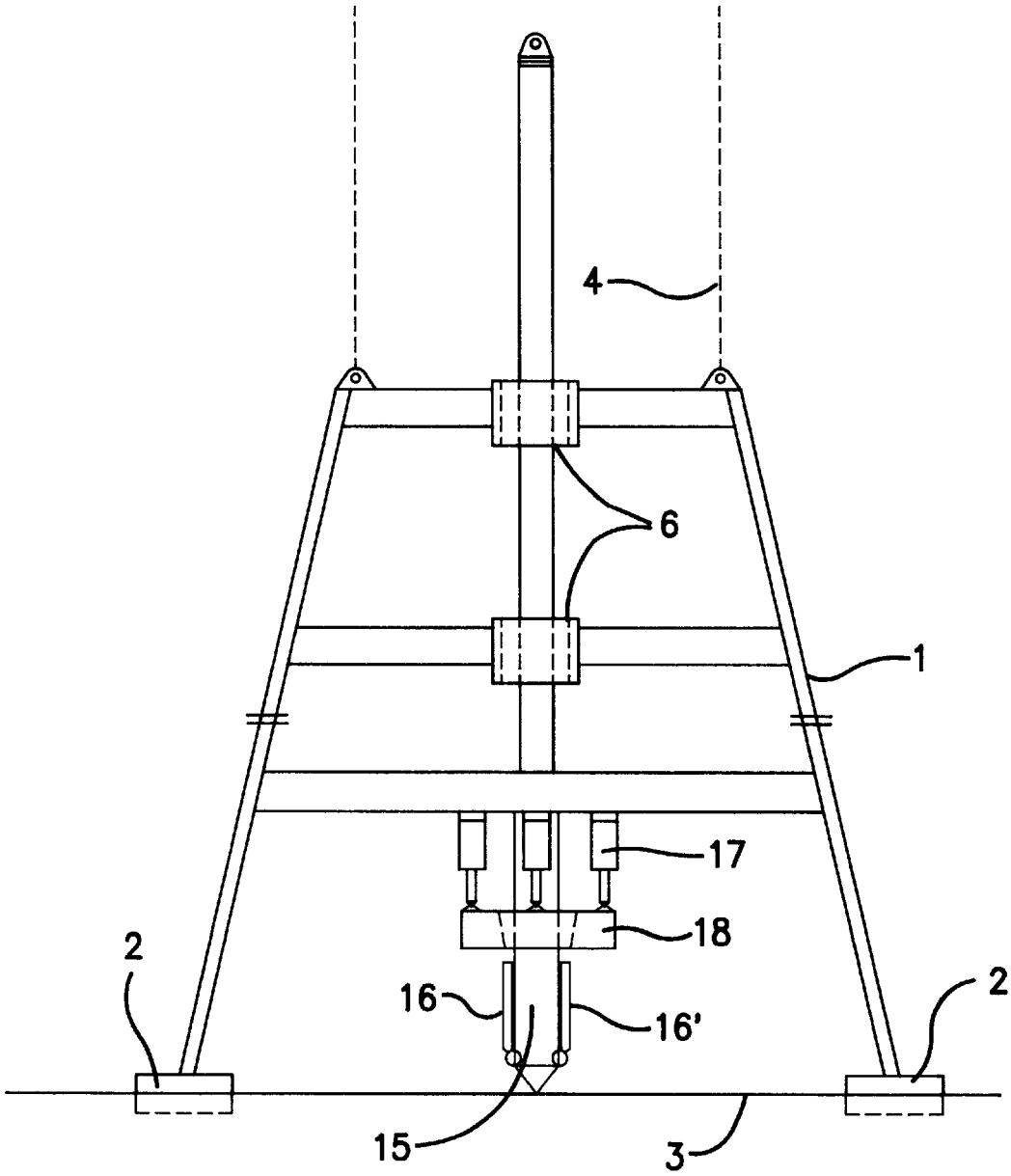
FIG. 4 illustrates an embodiment of the invention utilizing plate anchors.

FIG. 4 illustrates a cylindrical solid anchor 15 with hinged attachment for two plate anchors 16 and 16' in the lower position vertically mounted in the frame's 1 suspension equipment 6, where the plate anchor oscillates 90° out and up to a locked position on the anchor body when the anchor is exposed to an upwardly directed force. This anchor is pressed/pushed down into the sea bed 3 by hydraulic cylinders 17 with a sliding rim 18.

Figure 5:
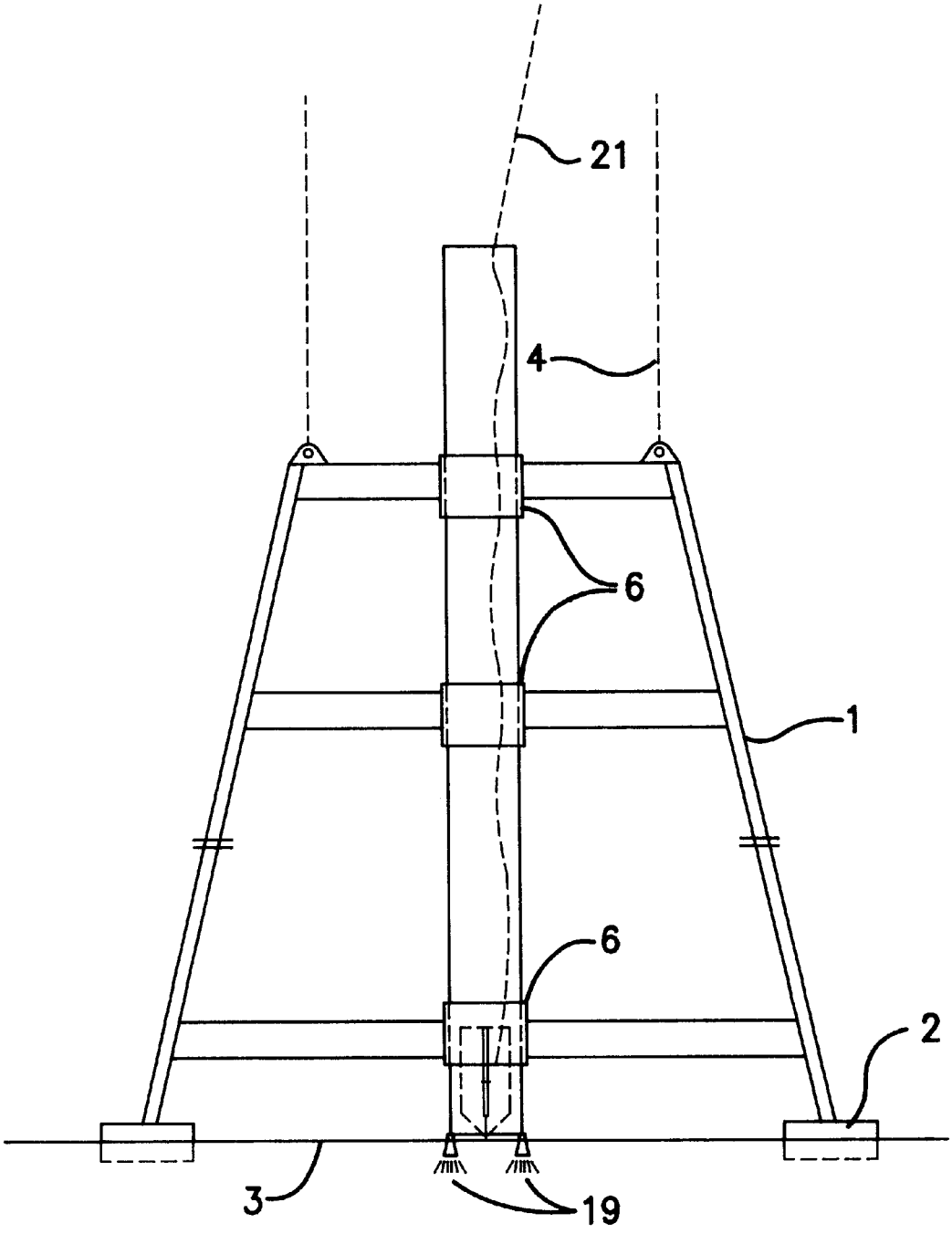
FIG. 5 illustrates an embodiment of the invention utilizing water nozzles.

FIG. 5 illustrates a hollow metallic anchor holder 7 with a cylindrical or square cross section for lowering to the bottom by jetting with water, nozzles 19 and injecting suspended vertically in the frame's 1 suspension equipment 6, where flat plate anchors 20 coupled to the anchor line 21 accompanying them during the lowering operation are set up, inside a square pipe also diagonally for folding out at a 90° angle to a locked position on the anchor body.

Figure 6:
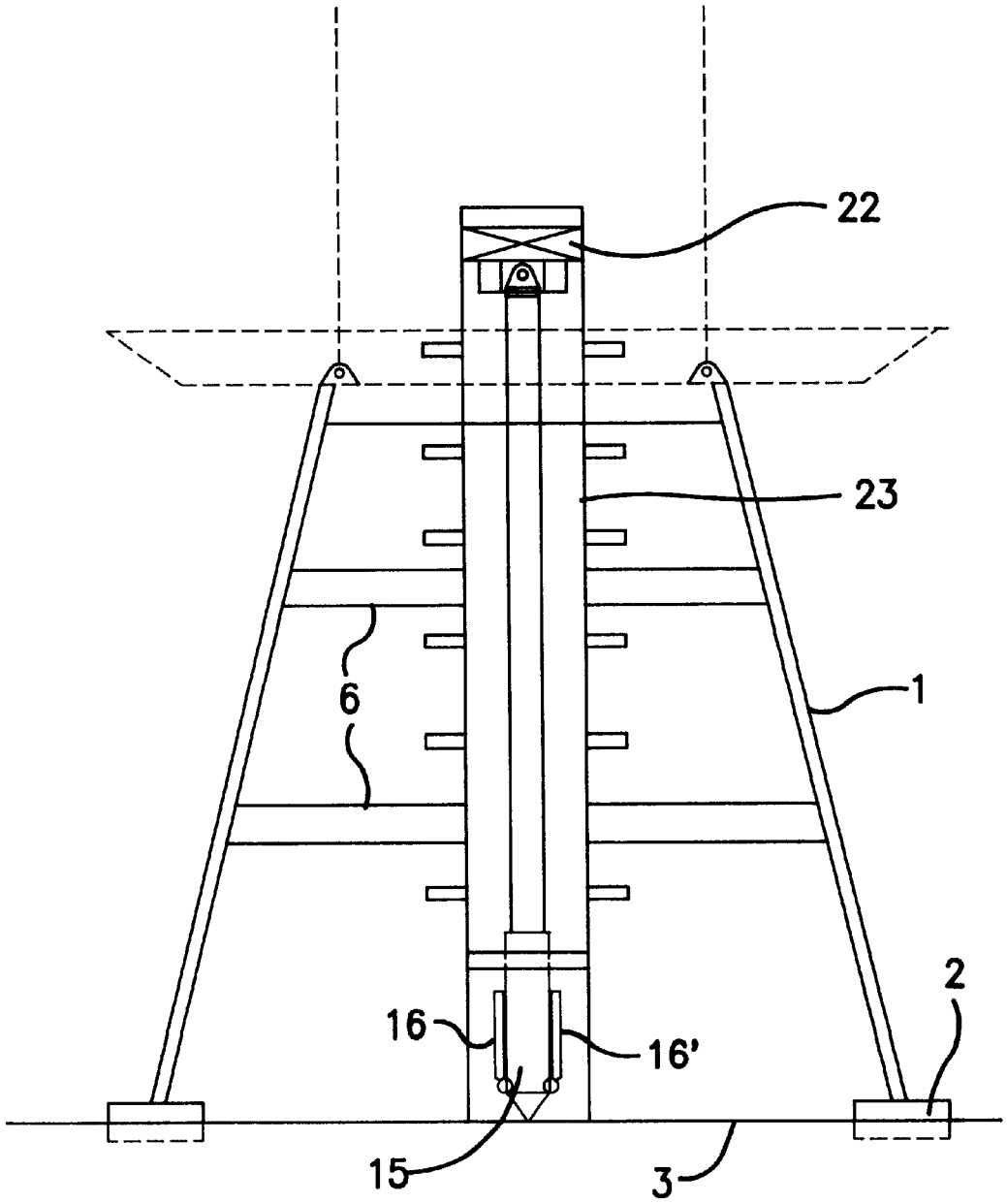
FIG. 6 illustrates an embodiment of the invention utilizing a hydrostatic piston.
Figure 7:
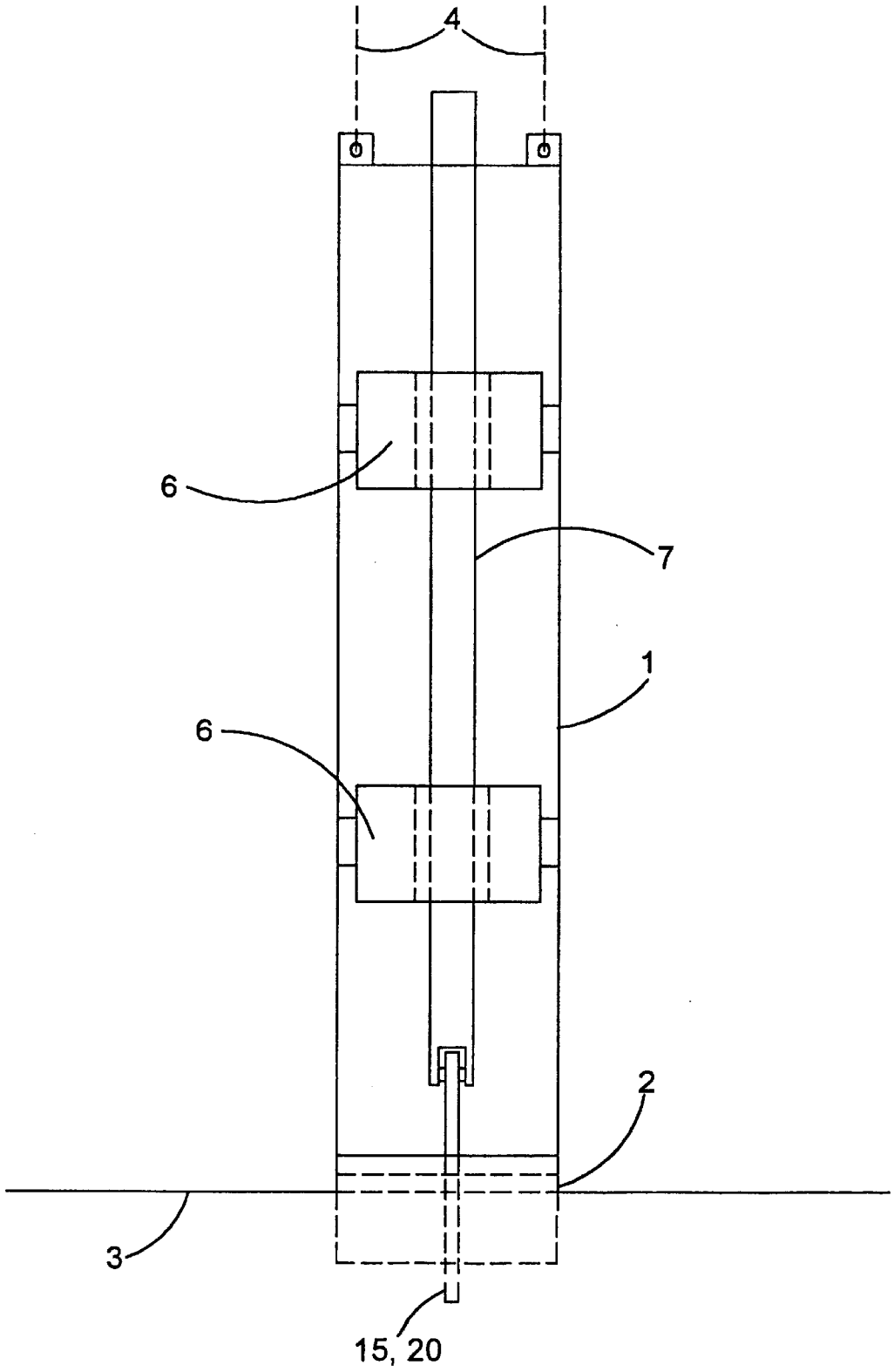
FIG. 7 illustrates a front view of an embodiment of the invention utilizing a single vertical leg frame.
Figure 8:
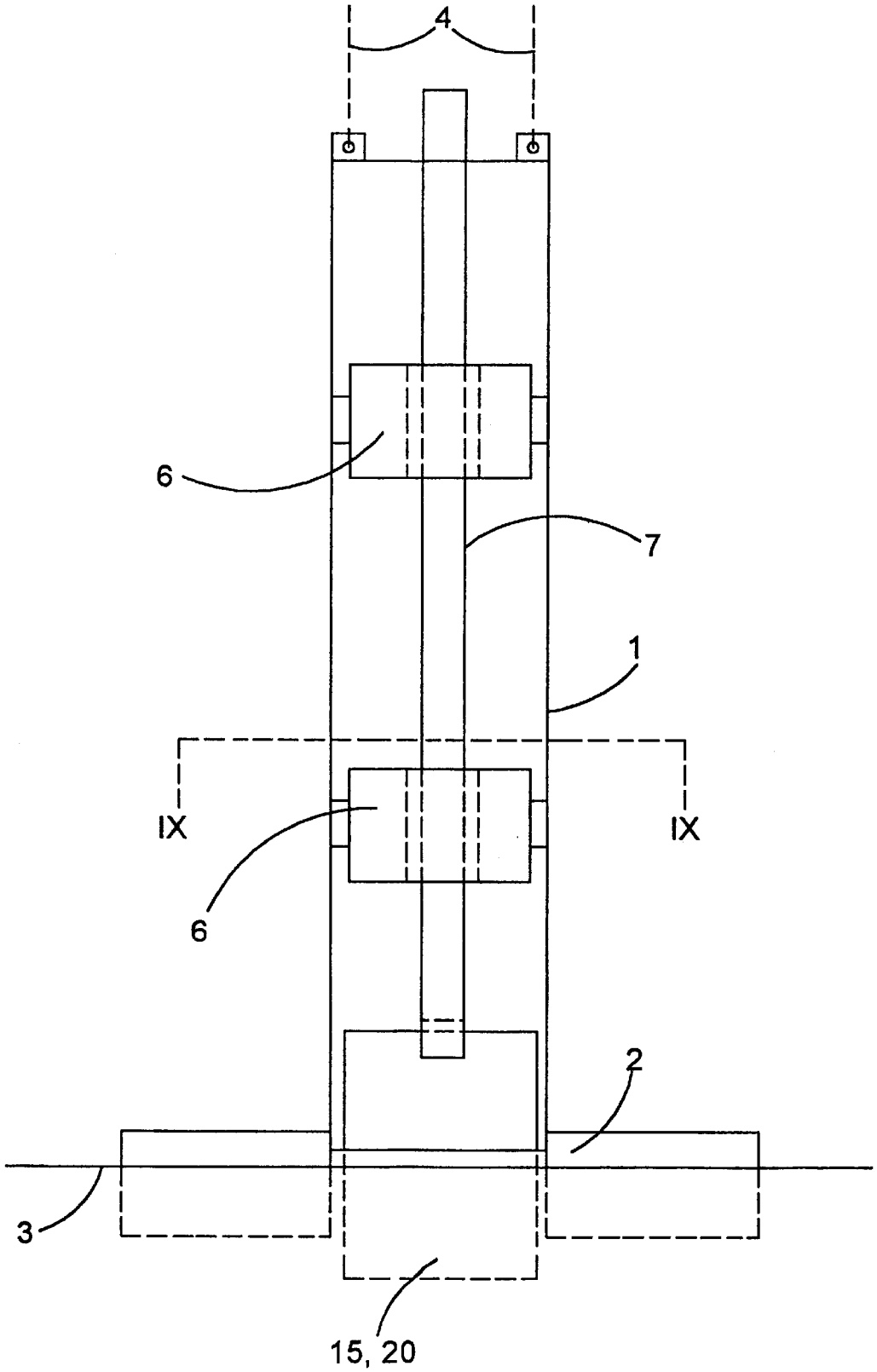
FIG. 8 illustrates a side view of the embodiment of FIG. 7.
Figure 9:
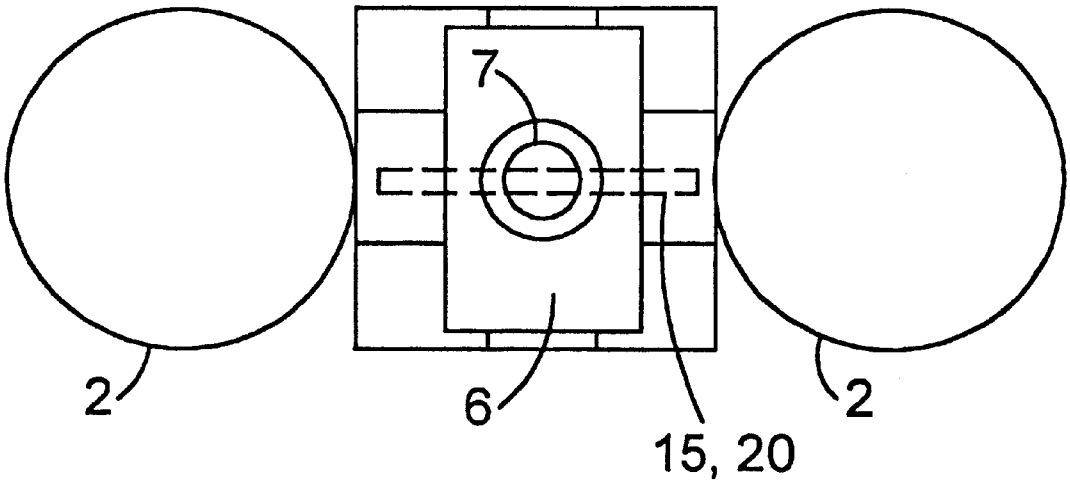
FIG. 9 illustrates a sectional view of the embodiment illustrated in FIG. 8.

FIG. 6 illustrates the anchor 15 with two plate anchors 16 and 16' for penetration of the sea floor 3 mounted vertically in the frame's 1 suspension equipment by means of a hydrostatic piston 22, which according to the prior art is lowered in a closed cylindrical container 23 from the surface at 1 bar pressure to, e.g., 1000 m at 100 bar, 5000 m at 500 bar etc., thus obtaining a power release when opening a sealing packing on the underside of the cylindrical container 23.

What is claimed is:

1. A device for establishing, connecting and disconnecting positioned anchor points in different sea floor formation, comprising:

a ramming down ramp comprising a frame with at least one leg with a wireline attached at an upper end of the at least one leg for lowering the ramming down ramp to a sea floor, at least one suction anchors attached at a lower part of the frame, control and suspension equipment arranged centrally through a vertical axis of the frame (1) for insertion of cylindrical anchor holders adapted to an anchor arranged vertically through the frame's suspension equipment, at least one hydraulic cylinder with a sliding rim, and a remotely controlled and power-generating tool, which by means of a hydraulic motor and pump produces torque for drilling, screwing, high-pressure jetting and injecting effects, said remotely controlled and power-generating tool being releasably fixed to the frame (1).

2. The device according to claim 1, further comprising a carrier attached to the anchor holders.

3. The device according to claim 1, wherein the anchor holders are arranged with nozzles for jetting action directed substantially towards the sea floor.

4. The device according to claim 1, further comprising a release mechanism, wherein the release mechanism is adapted to break a securing co-operation in a shackle between the anchor and a catenary.

5. The device according to claim 4, wherein the release mechanism comprises a marker for retrieval and connection in subsequent operations.

6. The device according to claim 1, wherein the anchor holders have one of a cylindrical and square anchor body, further comprising surrounding curved plate anchors hinged at one of an upper and lower part, so that the curved plate anchors will oscillate out to a 90° locked position on the anchor body when the anchor is exposed to an upwardly or downwardly directed force.

7. The device according to claim 1, wherein the frame's suspension equipment is designed to receive the anchor.

8. The device of claim 1, wherein the at least one leg consists of a single vertical leg.

9. The device of claim 1, wherein the anchor holders are connected to the anchor, and the anchor comprises plate anchors.

10. The device of claim 1, wherein the anchor holders are connected to the anchor, and the anchor is a threaded anchor.

11. The device of claim 1, wherein the at least one leg comprises a plurality of legs.

12. The device of claim 11, wherein the plurality of legs are inwardly sloped and arranged as a truncated pyramid.

13. The device of claim 11, wherein the plurality of legs are arranged vertically.

14. The device of claim 11, wherein the anchor holders substantially surround the anchor, and the anchor comprises plate anchors.

15. The device according to claim 14, wherein the anchor is a helically flanked threaded anchor adapted to be screwed into the sea floor.

16. The device according to claim 1, wherein the anchor is releasably attached to a hydrostatic piston, contained in a closed container, a sealing packer being arranged at a lower part of the closed container so that the sealing packer may be released when the hydrostatic piston is required to move the anchor into the sea floor.

17. A method for establishing and connecting and disconnecting positioned anchor points in different sea floor formations utilizing a device according to claim 16, comprising the steps of:

releasably attaching the anchor to the hydrostatic piston, placing the piston inside the container, closing and sealing off the container before the container is lowered into the sea, lowering the anchor to the sea floor, and opening the sealing packer so that the piston is allowed to be moved by differential pressure between an inside and an outside of the container.

18. A method for establishing and connecting and disconnecting positioned anchor points in different sea floor formations, comprising the steps of:

providing the device according to claim 1, lowering the ramming down ramp to the sea floor at approximately a correct location, further lowering the ramming down ramp by utilization of a hydrostatic differential pressure created in the suction anchors, so that the anchor which is mounted in an approximately vertical position through the fraim's suspension equipment is driven into the sea bed, subjecting the anchor to an approximately vertical force submitted by said at least one hydraulic cylinder with a sliding firm, positioning the anchor at a predetermined level/depth by the approximately vertical force, elevating the ramming down ramp by utilizing a reversed hydrostatic differential pressure created in the suction anchors so that the anchor may unfold to an approximately horizontal position by pulling forces from an anchor line (21) mainly attached to a central portion of the anchor, releasing the anchor line from the ramming down ramp.

19. The method according to claim 18, wherein after the anchor is placed and the anchor line is released from the rearing down ramp, the ramming down ramp is withdrawn to a surface of the water for reloading and reuse.

20. The method according to claim 18, wherein after the anchor is placed and the anchor line is released from the ramming down ramp, the ramming down ramp is loaded with a new said anchor under water and shifted to a new location for positioning of the new anchor.

* * * * *